US007837492B2

(12) United States Patent
Zhu

(10) Patent No.: US 7,837,492 B2
(45) Date of Patent: Nov. 23, 2010

(54) ELECTRICAL CONNECTOR HAVING MATCHED IMPEDANCE BY CONTACTS HAVING NODE ARRANGEMENT

(75) Inventor: Yu Zhu, ShenZhen (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 197 days.

(21) Appl. No.: 12/291,598

(22) Filed: Nov. 12, 2008

(65) Prior Publication Data

US 2009/0124107 A1 May 14, 2009

(30) Foreign Application Priority Data

Nov. 12, 2007 (CN) ..... 2007 2 0042233 U

(51) Int. Cl.
*H01R 13/62* (2006.01)

(52) U.S. Cl. ..... 439/329; 439/941

(58) Field of Classification Search ..... 439/329, 439/941

See application file for complete search history.

(56) References Cited

U.S. PATENT DOCUMENTS

| | | | | |
|---|---|---|---|---|
| 5,522,737 | A | 6/1996 | Brunker et al. | |
| 6,283,795 | B1 * | 9/2001 | Chen | 439/676 |
| 6,338,635 | B1 * | 1/2002 | Lee | 439/108 |
| 6,394,823 | B1 | 5/2002 | Dunham et al. | |
| 6,439,931 | B1 * | 8/2002 | Niitsu et al. | 439/660 |
| 6,447,340 | B1 * | 9/2002 | Wu | 439/660 |
| 6,863,549 | B2 * | 3/2005 | Brunker et al. | 439/108 |
| 7,025,617 | B2 | 4/2006 | Regnier et al. | |
| 7,048,567 | B2 * | 5/2006 | Regnier et al. | 439/329 |
| 7,351,120 | B1 | 4/2008 | Gilliland et al. | |
| 7,485,009 | B1 * | 2/2009 | Zhu | 439/660 |
| 7,670,199 | B2 * | 3/2010 | Nagata et al. | 439/92 |
| 2009/0017697 | A1 * | 1/2009 | Zhu | 439/682 |
| 2009/0124107 | A1 * | 5/2009 | Zhu | 439/329 |
| 2009/0311887 | A1 * | 12/2009 | Zhu | 439/67 |
| 2010/0055977 | A1 * | 3/2010 | Zhu | 439/571 |

FOREIGN PATENT DOCUMENTS

| | | |
|---|---|---|
| TW | 271276 | 7/2005 |
| TW | 271281 | 7/2005 |

* cited by examiner

*Primary Examiner*—James Harvey
(74) *Attorney, Agent, or Firm*—Wei Te Chung; Andrew C. Cheng; Ming Chieh Chang

(57) ABSTRACT

An electrical connector includes an insulative housing and a number of conductive contacts received in the insulative housing. Each conductive contact has a contacting portion, an engaging portion and an extension portion electrically connecting with the contacting portion and the engaging portion. A node is disposed in the extension portion for matching characteristic impedance of the conductive contact, and a positioning portion is disposed in the insulative housing corresponding to the node for cooperating with the node to restrict movement of the node. The electrical connector in accordance with the present invention can match characteristic impedance of the conductive contact to realize impedance match and can assure precise positioning of the conductive contact.

5 Claims, 8 Drawing Sheets

ELECTRICAL CONNECTOR HAVING MATCHED IMPEDANCE BY CONTACTS HAVING NODE ARRANGEMENT

BACKGROUND OF THE INVENTION

1. Field of the Invention

The present invention is generally related to the art of electrical connector for use in transmitting high frequency signals and more particularly to methods and structures for controlling the impedance in electrical connector to match given impedance.

2. Description of Related Art

Electrical connectors are widely applied to the electronic industry. For example, the electrical connector is used for electrical connection and signal transmittance between elements, assemblies or systems of an electronic device.

In today's high-speed electronic devices, it is required to optimize interconnection routes among all the components for improving signal transmitting characteristic. Or else, the performance of the whole system will be weakened or reduced. In an ideal case, signal can be transmitted from one circuit to another circuit via the electrical connectors without loss and delay, and the electrical connectors could hardly affect electrical performance of the system. But actually, it is no possible to manufacture the ideal electrical connectors. Thus it is desired to make an electrical connector having a small effect on signal transmittance to the greatest extent. For instance, characteristic impedance of the electrical connector can be matched by changing structure of the electrical connector for matching with given impedance, thereby minimizing the effect on the circuit interconnection.

On the other hand, most of the electrical connectors usually adopt surface mounted technology (SMT) which is adapted to mounting of high precision. However, it is very important to position conductive contacts of the electrical connector during the SMT process. Once a conductive contact is displaced, the electrical connector is mounted improperly, so that the circuit can't be normally electrically communicated.

Hence, an improved electrical adapter is required to overcome the disadvantages of the prior art.

SUMMARY OF THE INVENTION

Accordingly, an object of the present invention is to provide an electrical connector including conductive contacts which has characteristic impedance matching with a given impedance and are positioned precisely.

An aspect of the present invention provides an electrical connector comprising an insulative housing having a horizontal mounting surface and a vertical rear face, and a plurality of conductive contacts received in the insulative housing. Each conductive contact has a contacting portion horizontally inserted through said rear face, an engaging portion extending to said mounting surface, and a vertical extension portion electrically connecting with the contacting portion and the engaging portion. Said extension portion is thinner and shorter than said contacting portion. A node wider than others of the extension portion is disposed on the extension portion for making characteristic impedance of the conductive contact matching demand, and a positioning portion is disposed in the insulative housing corresponding to the node for cooperating with the node to restrict movement of the node.

Another aspect of the present invention provides an electrical connector comprising an insulative housing comprising a plurality of positioning portions in a rear surface thereof, and a plurality of conductive contacts inserted to and received in the insulative housing from the rear surface of the insulative housing. Each conductive contact comprises an impedance matching node corresponding to the positioning portion and restricted by the corresponding positioning portion.

The electrical connector according to the embodiments of the present invention disposes a node in the extension portion of the conductive contact. The extension portion has a longer length, so the extension portion has an enough space to dispose the node properly for matching characteristic impedance of the conductive contact. For example, capacitance of the conductive contact can be increased by increasing the cross-sectional area of the extension portion of the conductive contact, thereby reducing characteristic impedance of the conductive contact. In contrary, capacitance of the conductive contact can be reduced by reducing the cross-sectional area of the extension portion of the conductive contact, thereby increasing characteristic impedance of the conductive contact. Furthermore, capacitance of the conductive contact can be increased by decreasing the space between the extension portions of the conductive contact, thereby reducing characteristic impedance of the conductive contact. In contrary, capacitance of the conductive contact can be decreased by increasing the space between the extension portions of the conductive contact, thereby increasing characteristic impedance of the conductive contact. The positioning portion disposed in the insulative housing can cooperate with the node to restrict movement of the node, so as to position the conductive contact precisely. Therefore, by adopting the simple structure, the electrical connector in accordance with the embodiments of the present invention not only can match characteristic impedance of the conductive contact to match with given impedance, but also can assure precise positioning of the conductive contact.

Other objects, advantages and novel features of the present invention will become more apparent from the following detailed description of the present embodiment when taken in conjunction with the accompanying drawings.

DETAILED DESCRIPTION OF THE INVENTION

Figure 1:
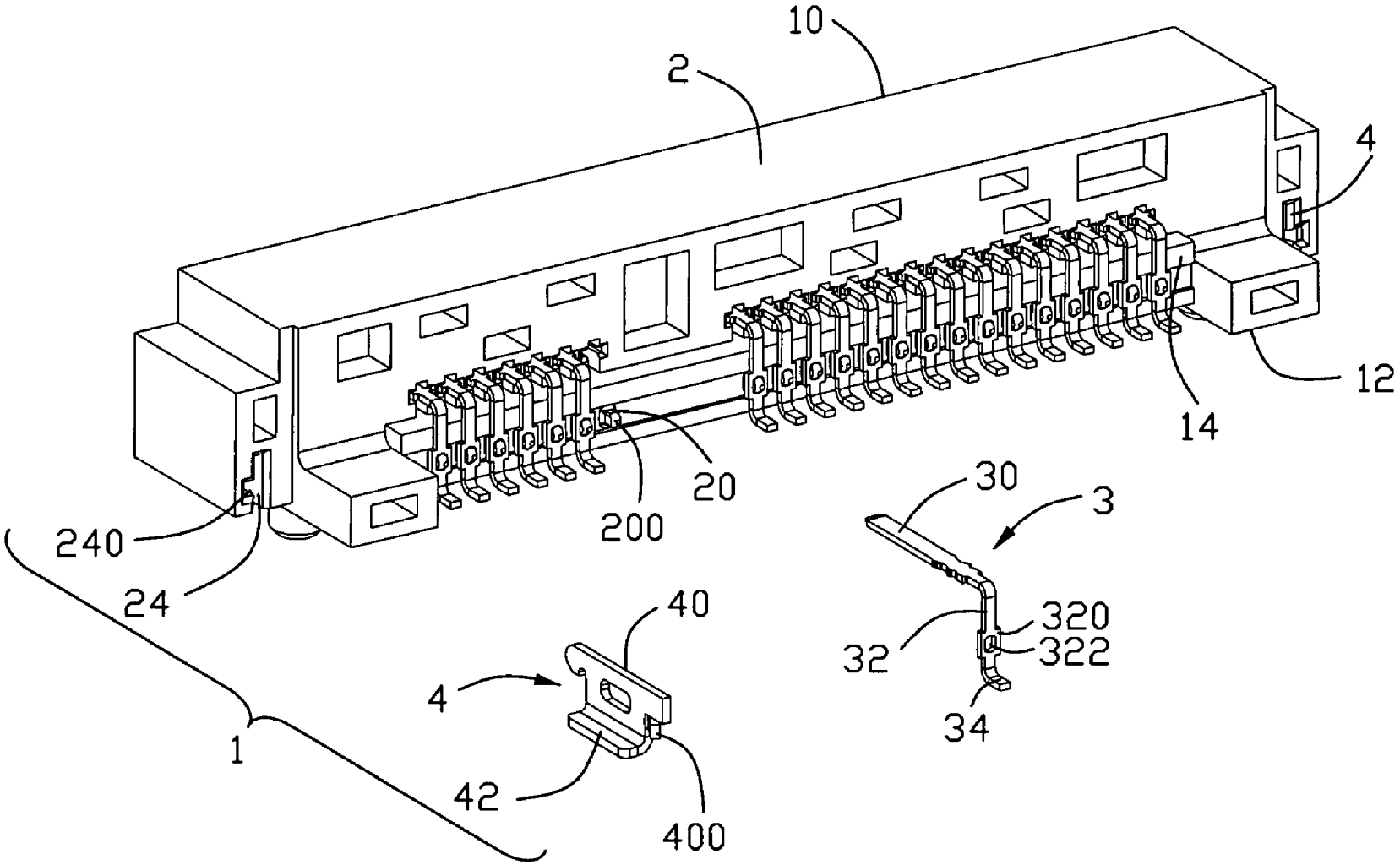
FIG. 1 is a partly exploded, perspective view of an electrical connector in accordance with a first embodiment of the present invention, illustrating a positioning portion of a housing, a conductive contact and a latching member therein.
Figure 2:
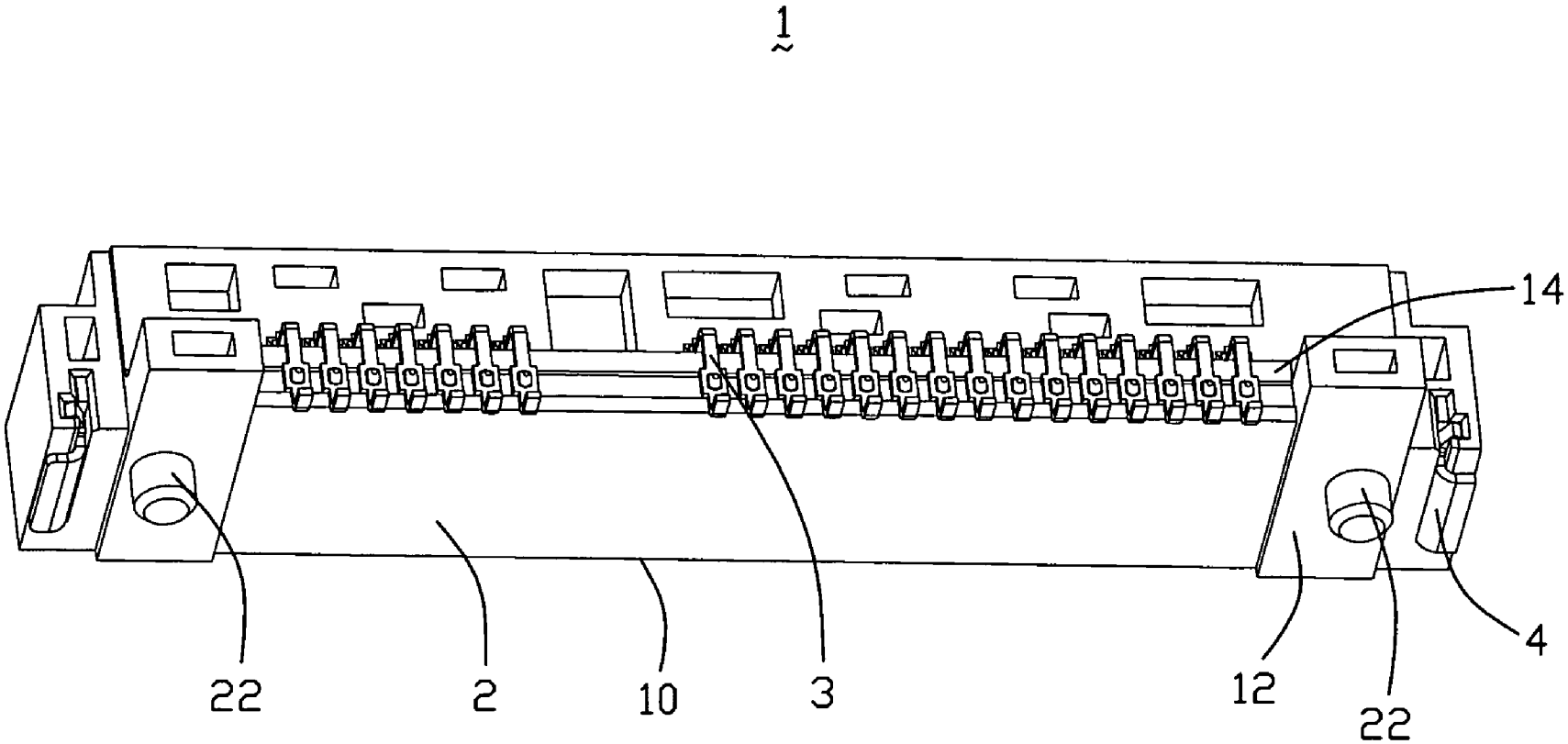
FIG. 2 is a perspective view similar to FIG. 1 but taken from a different perspective.
Figure 3:
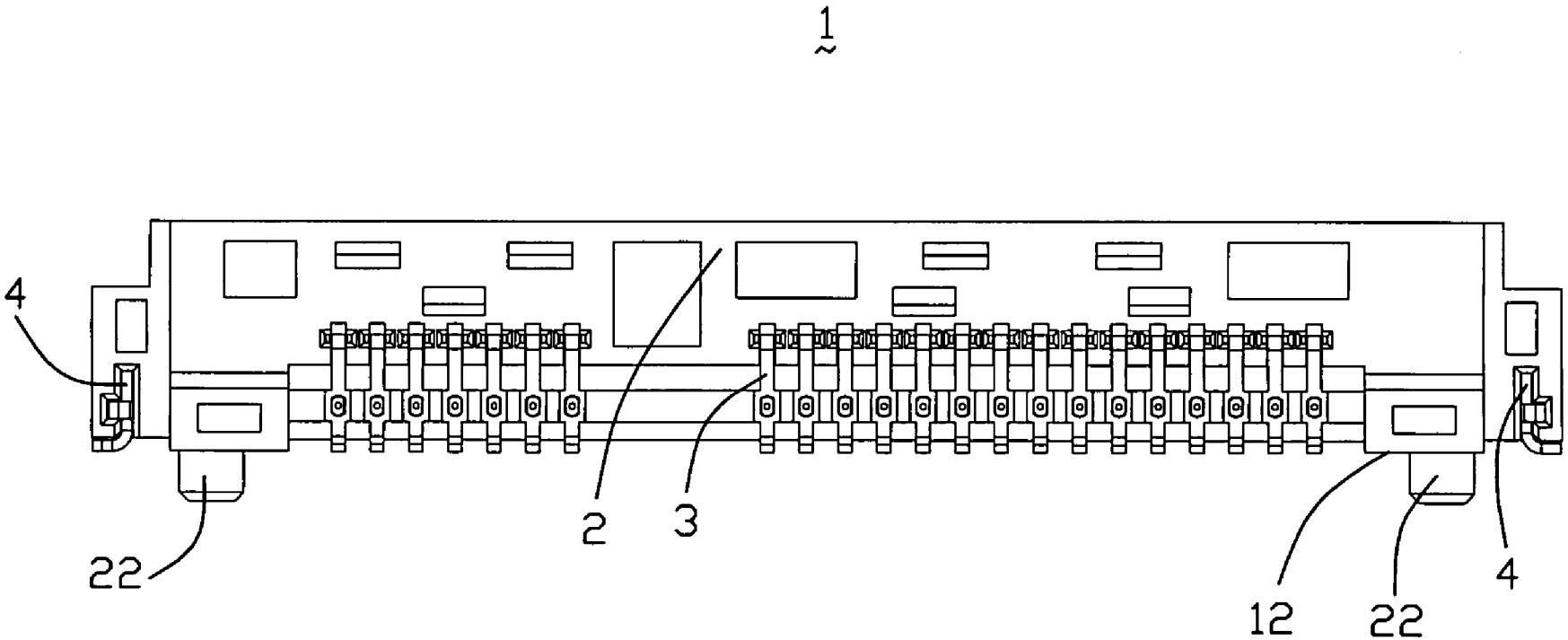
FIG. 3 is a rear plan view of the electrical connector of FIG. 1.
Figure 4:
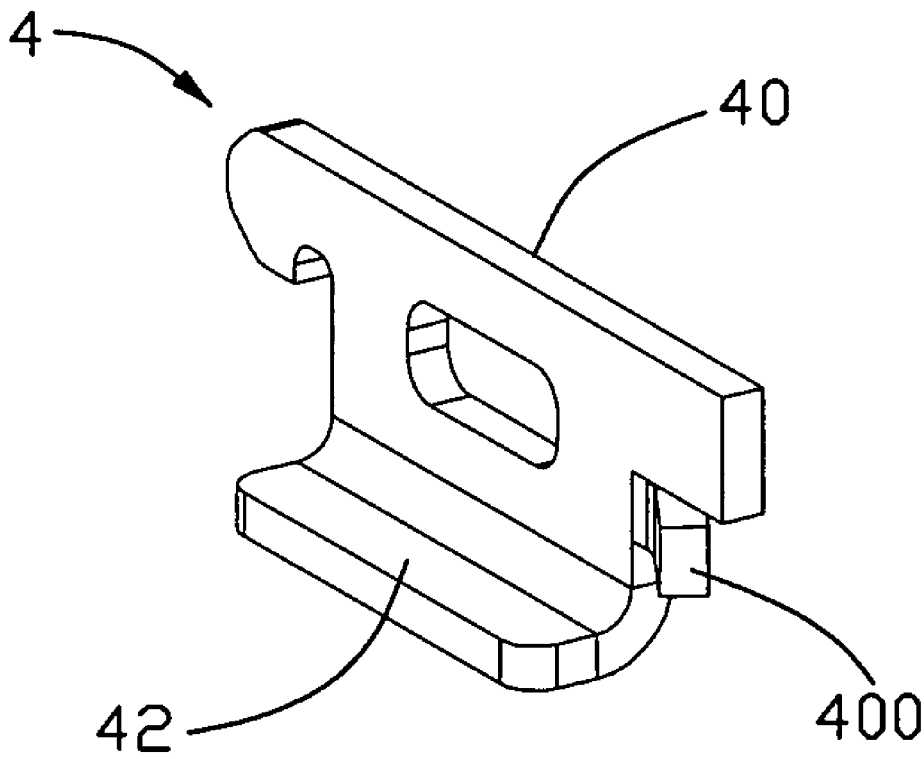
FIG. 4 is detail view of the conductive contact as shown in FIG. 1.
Figure 5:
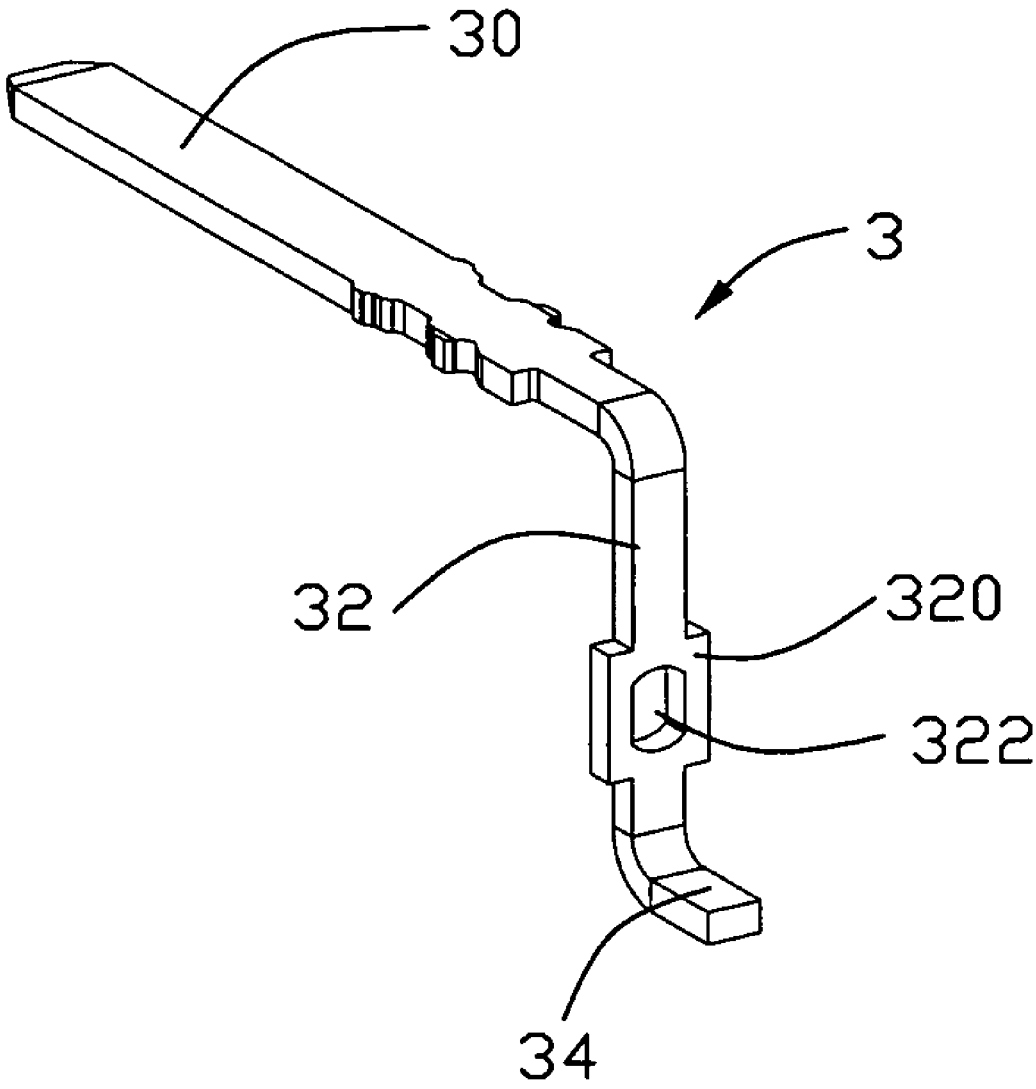
FIG. 5 is detail view of the latching members as shown in FIG. 1.

Hereinafter, in order to make the above objects, features and advantages to be easily understood, embodiments of the present invention will be described in detail with reference to the accompanying drawings.

Referring to FIG. 1 to FIG. 5, an electrical connector 1 in accordance with a first embodiment of the present invention has a mating section 10 in a front thereof, and a mounting surface 12 in a bottom thereof and a rear surface 14 opposite to the mating section 10. The electrical connector 1 comprises an insulative housing 2, a plurality of conductive contacts 3 received in the insulative housing 2 and a pair of latching members 4 retained in the insulative housing 2.

A plurality of positioning portions 20 are disposed in the rear surface 14, and a protrusion 200 is disposed in each positioning portion. A pair of positioning posts 22 are respectively disposed in opposite longitudinal ends of the insulative housing 2 and protrudes from the mounting surface 12 for mating with a positioning hole of a printed circuit board (not shown) to secure the electrical connector to be precisely mounted in the printed circuit board. A pair of retaining slots 24 are respectively defined in the opposite longitudinal ends of the insulative housing 2. The retaining slot 24 defines a cutout 240 in a side wall perpendicular to the mounting surface 12.

The latching member 4 comprises a retention portion 40 retained in the retaining slot 24 of the insulative housing 2 and a mounting tail 42 extending to the mounting surface 12. A deflective tab 400 is disposed in the retention portion 42 corresponding to the cutout 240 and is held in the cutout 240.

The plurality of conductive contacts 3 are arranged in a row and are divided into two groups which can have different functions. For example, one group of conductive contacts is adapted for transmitting power and the other group of conductive contacts is adapted for transmitting signal. Each conductive contact 3 comprises a contacting portion 30 extending to the mating section 10 and partly exposed for contacting with corresponding conductive contacts of a complementary electrical connector (not shown), a surface-mounted engaging portion 34 extending in parallel to the mounting surface and an extension portion 32 perpendicular to the contacting portion 30 and electrically connecting the contacting portion 30 with the engaging portion 32. The extension portion 32 is thinner and wider than contacting portion 30, and the length of the extension portion 32 is shorter than one second of the whole length of the contact and the length of the extension portion 32 is shorter than the length of the contacting portion 30. A node 320 for matching characteristic impedance is disposed in the extension portion 32 of the conductive contact 3 corresponding to the positioning portion 20 of the insulative housing 2. The positioning portion 20 cooperates with the node 320 for restricting movement of the node 320. A through hole 322 is defined in a middle of the node 320, and the protrusion 200 of the positioning portion 20 of the insulative housing 2 is inserted to and is interferentially retained in the through hole 322.

The node 320 has a width greater than that of the others of the extension portion 32. So if taking no account of the through hole 322, a cross section of the node 320 is greater than that of the others of the extension portion 32. The node 320 is closer to other conductive contacts than the others of the extension portion 32. The node 320 can increase capacitance of the conductive contact 3. The through hole 322 defined in the node 320 can reduce conductive area of the node 320, so as to reduce capacitance of the conductive contact 3. According to related physical theory, characteristic impedance of the conductive contact 3 is inversely proportional to capacitance of the conductive contact 3. The extension portion 32 of the conductive contact 3 has a longer length enough to dispose the node 320 properly for effectively matching capacitance of the conductive contact 3 to realize impedance match.

Figure 6:
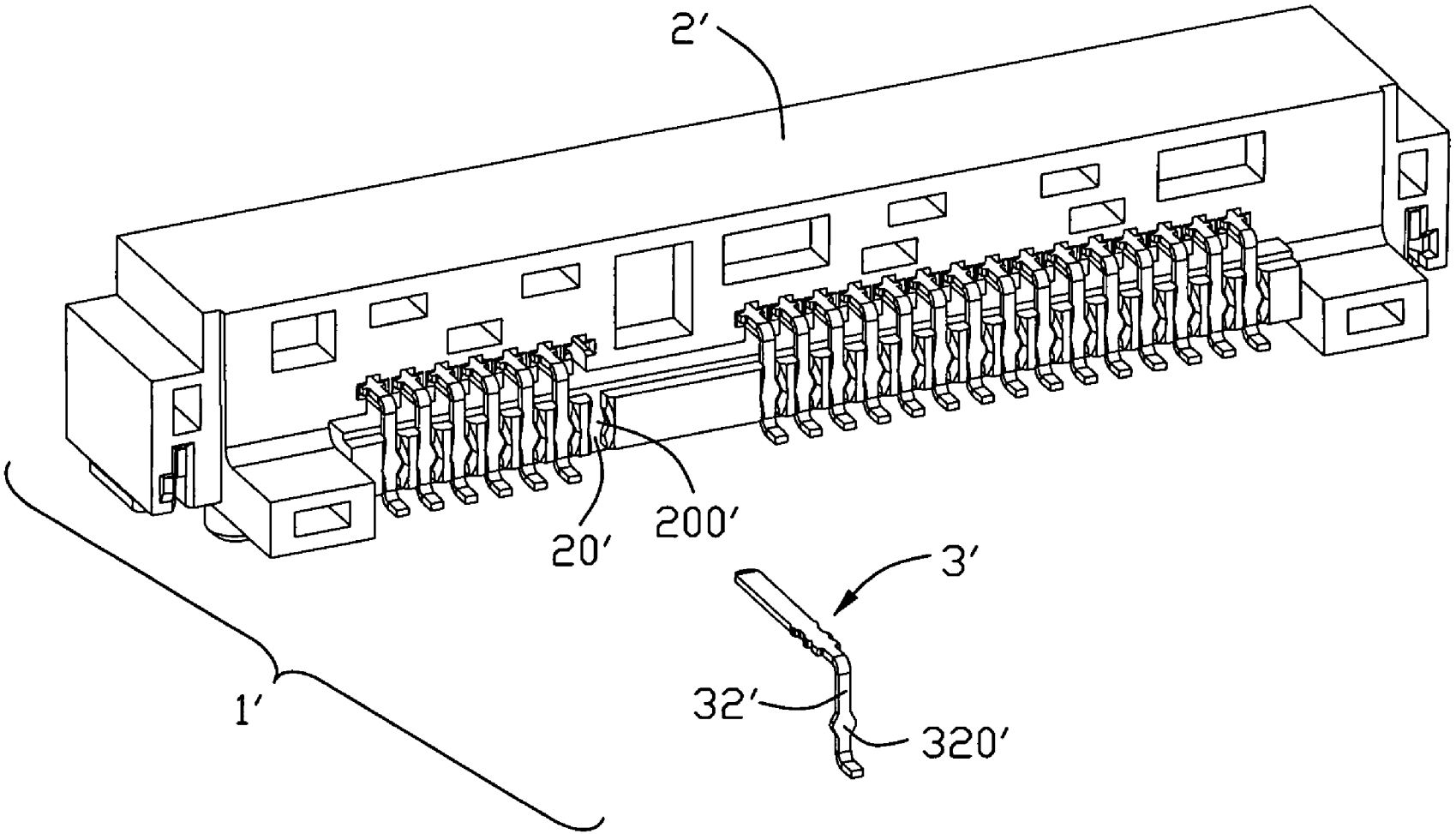
FIG. 6 is a partly exploded, perspective view of an electrical connector in accordance with a second embodiment of the present invention, illustrating a positioning portion of a housing and a conductive contact therein.
Figure 7:
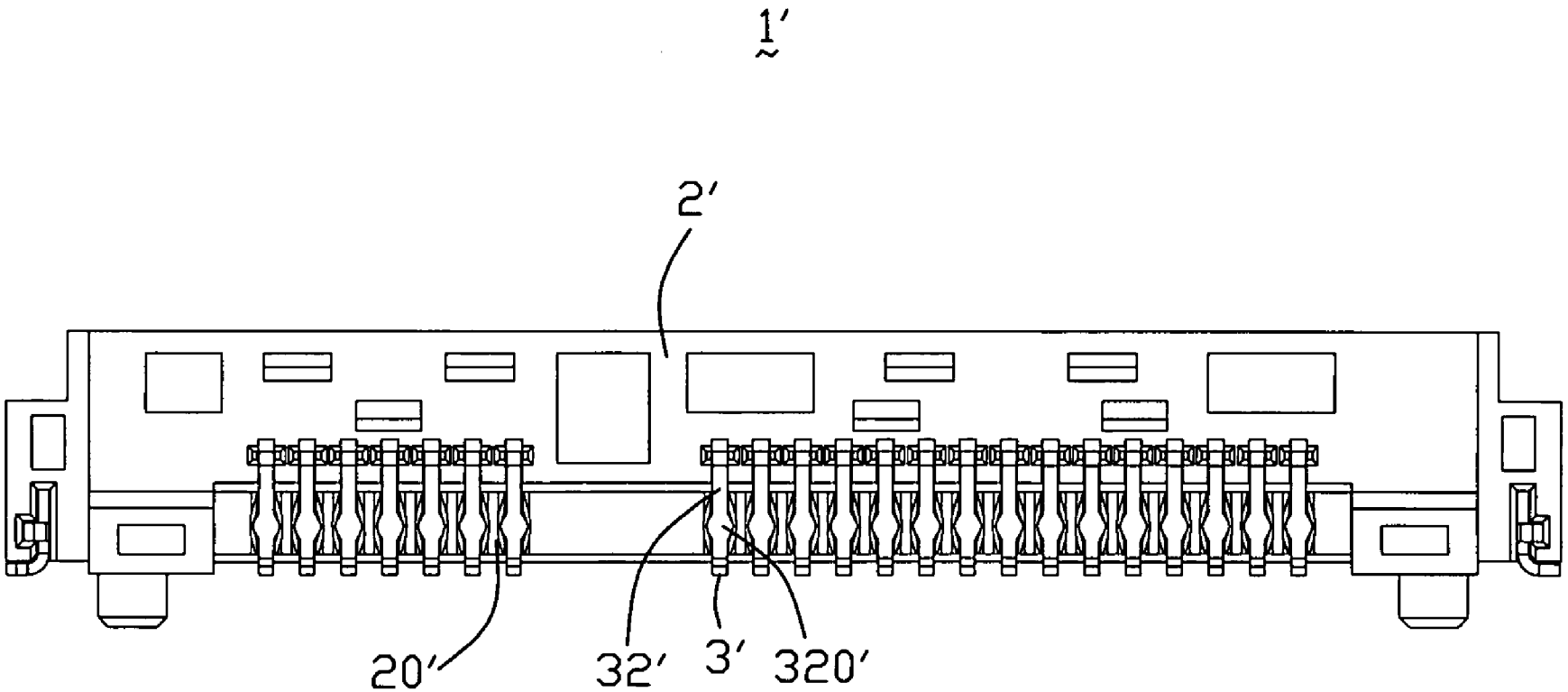
FIG. 7 is a rear plan view of the electrical connector of FIG. 6.
Figure 8:
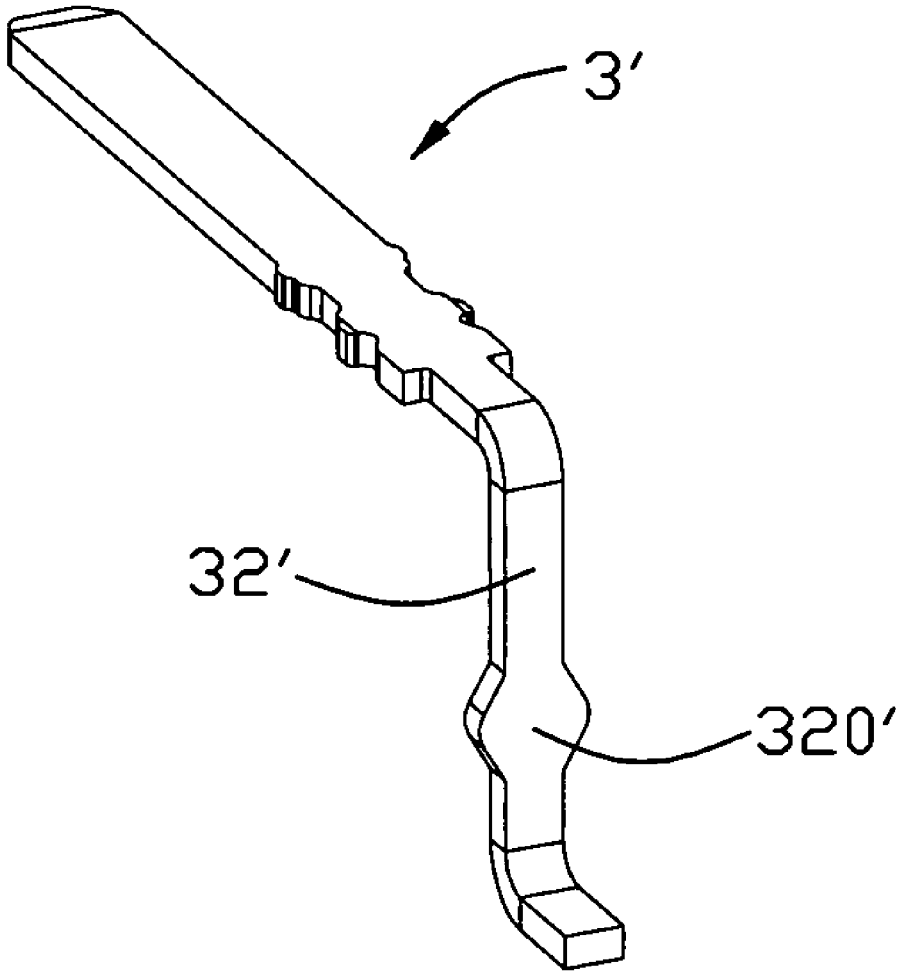
FIG. 8 is detail view of the conductive contact as shown in FIG. 6.

FIG. 6 to FIG. 8 illustrate an electrical connector 1' in accordance with a second embodiment of the present invention. Different from the first embodiment, in the second embodiment, the extension portion 32' of the conductive contact 3' disposes a projecting-shaped node 320' and the positioning portion 20' of the insulative housing 2' defines a recess 200' corresponding to the projecting-shaped node 320'. The projecting-shaped node 320' is restricted in the recess 200'. Similar to the first embodiment, capacitance of the conductive contact 3' can effectively matched to realize impedance match by changing the length or/and the width of projecting-shaped node 320'.

The extension portion 32, 32' of the conductive contact 3, 3' of the electrical connector 1, 1' in accordance with the first and the second embodiments of the present invention has a longer length, so the extension portion 32, 32' has an enough space to dispose the node 320 properly for matching characteristic impedance of the conductive contact 3. For example, capacitance of the conductive contact 3, 3' can be increased by increasing the cross-sectional area of the extension portion 32, 32' of the conductive contact 3, 3', thereby reducing characteristic impedance of the conductive contact 3. In contrary, capacitance of the conductive contact 3, 3' can be reduced by reducing the cross-sectional area of the extension portion 32, 32' of the conductive contact 3, 3, and thereby increasing characteristic impedance of the conductive contact 3. Furthermore, capacitance of the conductive contact 3, 3' can be increased by decreasing the space between the extension portions 32, 32' of the conductive contact 3, 3', thereby reducing characteristic impedance of the conductive contact 3. In contrary, capacitance of the conductive contact 3, 3' can be decreased by increasing the space between the extension portions 32, 32' of the conductive contact 3, 3', and thereby increasing characteristic impedance of the conductive contact 3. The positioning portion 20, 20' disposed in the insulatvie housing 2, 2' can cooperate with the node 320, 320' to restrict movement of the node 320, 320', so as to position the conductive contact precisely. Therefore, by adopting the simple structure, the electrical connector 1, 1' in accordance with the embodiments of the present invention not only can match characteristic impedance of the conductive contact 3, 3' to realize impedance match, but also can assure precise positioning of the conductive contact 3, 3'.

The forgoing descriptions disclose the embodiments of the present invention but do not intend to limit the present invention. Additional advantages and modifications will readily occur to those skilled in the art. Therefore, the invention in its broader aspects is not limited to the specific details and representative embodiments shown and described herein. Accordingly, various modifications and variations may be made without departing from the scope of the invention as defined by the appended claims and their equivalents.

What is claimed is:

1. An electrical connector comprising:

an elongate insulative housing having a horizontal mounting surface and a vertical rear face; and a plurality of conductive contacts received in the insulative housing and each comprising a contacting portion horizontally inserted through said rear face, an engaging portion extending to said mounting surface, and a vertical extension portion electrically connecting with the contacting portion and the engaging portion, wherein said extension portion is thinner and shorter than said contacting portion, said extension portion has a node that is wider than other portions of the extension portion, said node is adapted for making the characteristic impedance of the conductive contact matching demand;

a positioning portion is disposed in the insulative housing corresponding to the node for cooperating with the node to restrict movement of the node; and wherein the node of the extension portion of the conductive contact defines a through hole in a middle thereof and the positioning portion of the insulative housing disposes a protrusion corresponding to the through hole, the protrusion being inserted to and being retained in the through hole.

2. The electrical connector according to claim 1, wherein the node of the extension portion has a greater cross section than that of the others of the extension portion.

3. The electrical connector according to claim 1, wherein an edge of the node of the extension portion is closer to other conductive contacts than the others edges of the extension portion.

4. An electrical connector comprising:

an elongate insulative housing having a horizontal mounting surface and a vertical rear face; and a plurality of conductive contacts received in the insulative housing and each comprising a contacting portion horizontally inserted through said rear face, an engaging portion extending to said mounting surface, and a vertical extension portion electrically connecting with the contacting portion and the engaging portion, wherein said extension portion is thinner and shorter than said contacting portion, said extension portion has a node that is wider than other portions of the extension portion, said node is adapted for making the characteristic impedance of the conductive contact matching demand;

a positioning portion is disposed in the insulative housing corresponding to the node for cooperating with the node to restrict movement of the node;

wherein a mating section in a front thereof, a mounting surface in a bottom thereof and a rear surface opposite to the mating section, wherein the positioning portion of the insulative housing is disposed in rear surface;

wherein the contacting portion of the conductive contact extends to the mating section and is partly exposed, and the engaging portion of the conductive contact extends in parallel to the mounting surface;

wherein the plurality of conductive contacts are arranged in a row and comprise two groups of conductive contacts;

wherein a pair of positioning posts are respectively disposed in longitudinal ends of the insulative housing and protrude from the mounting surface;

wherein a pair of latching members each comprising a retention portion retained in the insulative housing, a mounting tail extending to the mounting surface, wherein a pair of retaining slots are defined in longitudinal ends of the insulative housing, and the retention portion of the latching member is retained in the retaining slot; and wherein the retaining slot of the insulative housing defines a cutout in a side wall thereof perpendicular to the mounting surface, and the retention portion of the latching member disposes a deflective tab corresponding to the cutout and held in the cutout.

5. The electrical connector according to claim 1, wherein the node of the extension portion has a projecting shape, and the positioning portion of the insulative housing defines a recess corresponding to the projecting-shaped node, the projecting-shaped node being restricted in the recess.

* * * * *